United States Patent [19]

Taber

[11] 3,932,950

[45] Jan. 20, 1976

[54] FOOTWEAR WITH NON-SLIP TREAD

[75] Inventor: George J. Taber, Buffalo, N.Y.

[73] Assignee: Tractioneers, Inc., Buffalo, N.Y.

[22] Filed: Nov. 14, 1974

[21] Appl. No.: 523,656

[52] U.S. Cl. ..... 36/59 R; 36/32 R
[51] Int. Cl.[2] ..... A43B 23/28; A43B 13/04
[58] Field of Search ..... 36/32 R, 59 R, 59 C, 2.5 R

[56] References Cited

UNITED STATES PATENTS

| | | | |
|---|---|---|---|
| 1,985,578 | 12/1934 | Murray | 36/32 R |
| 3,327,334 | 6/1967 | Wilmanns et al. | 36/32 R |

*Primary Examiner*—Patrick D. Lawson
*Attorney, Agent, or Firm*—Shlesinger, Fitzsimmons & Shlesinger

[57] ABSTRACT

Shoes are provided with outsoles having molded protrusions which diminish wear and negate the slippages, interlocks and stickages that so frequently cause injuries to wearers of previous types of shoes and damage to turf or other surfaces on which the shoes are used. The shoes are especially intended for sportswear, by football and baseball players, for instance, and in a preferred design the treads or outsoles are made flexible and provided with integral, spaced, flexible protrusions of cylindrical or tapered, conical configuration. These protrusions interengage, for instance, with natural or artificial turf to provide a sure grip so that the wearer can make quick turns without falling or twisting an ankle.

3 Claims, 8 Drawing Figures

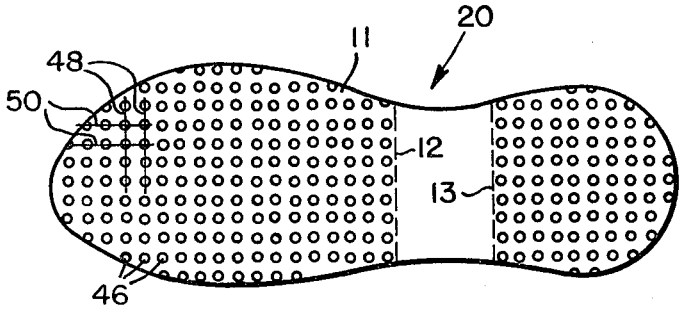
FIG. 1
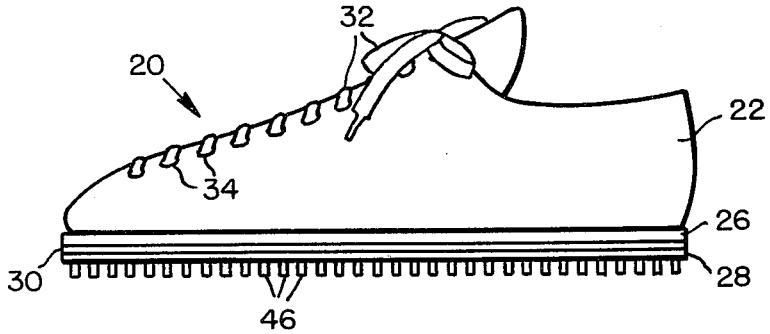
FIG. 2
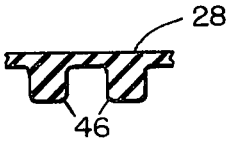
FIG. 3
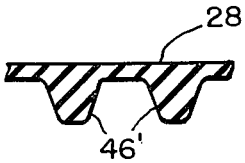
FIG. 4
FIG. 5
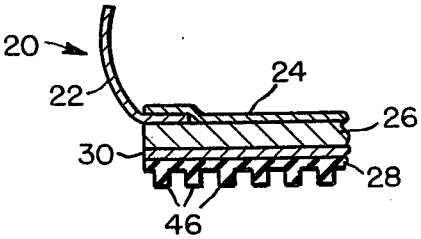
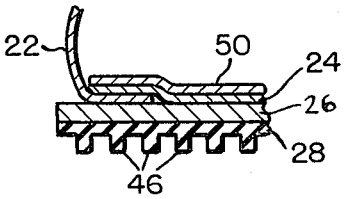
FIG. 6
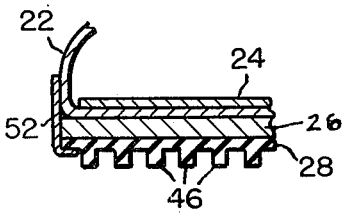
FIG. 7
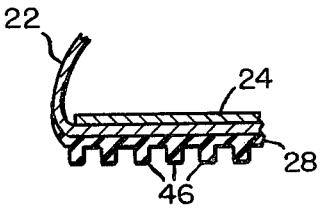
FIG. 8

FOOTWEAR WITH NON-SLIP TREAD

The invention relates to footwear generally and more directly to athletic shoes.

Previously proposed and currently used outsoles for athletic use have treads known to be ineffectual on sparsely grassed natural turfs, generally. They have been unreliable and the cause of injuries to the wearers or their opponents. With the development of artificial turf, the disadvantages of conventional athletic shoes have been multiplied. Conventional football shoes, for instance, are provided with hard chevron-like ribs or with rigid, spaced protuberances on their undersurfaces to provide a gripping effect on the playing field. Conventional baseball shoes are equipped with steel spikes to dig into the playing turf. These known athletic shoes are generally unsuitable on artificial turfs, and ruinous on natural turfs. Since the introduction of artificial turf, however, football and baseball players have been plagued with injuries, particularly with twisted ankles. A football or a baseball player has to make many quick, short turns in his game. It has been found that while the conventional football or baseball shoe provides the necessary traction in a forward or longitudinal direction it does not provide the flexibility and grip laterally, necessary to prevent injury to the athlete should he make a sudden turn.

For other uses, conventional outsoles having so-called non-slip treads with protrusile or protruding gripping surfaces are uniquely ineffectual in given applications, because of limitations in the numbers, diameters, lengths, distributions, spacing and shapes of their gripping surfaces.

The primary object of this invention is to provide shoes with improved outsoles for sportswear generally.

Another object of the invention is to provide outsoles for footwear having traction an wear qualities suitable for athletic use and by the public in general.

Another object of the invention is to provide an athletic shoe which will provide a surer grip for the athlete on either artificial or natural turf, regardless of the direction of his or her locomotion.

Still another object of the invention is to provide an outsole construction for footwear which will lend itself to formation into a full sole, a half sole, a heel or part thereof, for use on new footwear or for repair purposes.

Other objects of the invention will be apparent hereinafter from the specification and from the recital of the appended claims, particularly when read in light of the accompanying drawing.

In the drawing:

FIG. 1 is a diagrammatic bottom plan view of an outsole made according to one embodiment of this invention;

FIG. 2 is a side elevation of a shoe provided with such an outsole;

FIGS. 3 and 4 are sectional views illustrating two treads formed according to this invention with protrusions or projections on the outsole of the shoe;

FIG. 5 is a fragmentary sectional view showing how a shoe having an outsole made according to the present invention may be constructed; and FIGS. 6, 7 and 8 are similar fragmentary sectional views illustrating other shoe constructions.

Referring now to the drawing by numerals of reference, 20 denotes generally a shoe made according to one embodiment of this invention and comprising an upper 22 (FIGS. 2 and 5), an insole 24, a midsole 26, and outsole 28, and an outsole backing 30. This shoe, which is intended especially for football wear or similar sports activity, is adapted to be secured to the wearer's foot by a conventional lace 32 threaded through eyelets 34.

The outsole or tread of this shoe comprises a thin, flexible, rubber or neoprene body bonded to the backing 30, which, in turn, is bonded to the midsole 26. Here flexible projections or protrusions 46 are formed integral with the flexible outsole 28 to extend downwardly therefrom. These may be cylindrical or of inverted, truncated conical shape as shown in the enlarged FIGS. 3 and 4. They may cover the entire outsole (FIG. 2) or only a half sole and heel, or only th front half-sole, or only the heel, or only part of the heel. Preferably they are arranged in uniformly intersecting, criss-crossing lines 48, 50 (FIG. 1) except along the marginal edges of the tread where they may be disposed in accordance with the perimetral shape of the tread. The protrusions or protuberances in alternate rows may, however, be staggered with reference to one another.

These projections may be of various configurations, ranging from the cylindrical shape as shown in FIG. 3, to the modestly tapered or conical protrusions as illustrated at 46' in FIG. 4. The protrusions 46 shown by FIG. 3 may, for instance, be 5/32 in. in height and 5/32 in. in diameter, whereas the projections 46' shown by FIG. 4 may be for example 3/8 inch in height and 0.125 inch in diameter at their tips. Projections which are 3/8 inch in height on 0.25 inch centers and 0.1 inch to ..125 inch in diameter at their tips give a squeegeeing effect that provides optimum traction on wet boat or ship decks where a super squeegee effect is desirable. Projections, which are approximately 0.15 inch in diameter at their roots and 0.16 inch in height and 0.15 inch in diameter at their tips have been found best for artificial turf. The more the conical angularity of the protrusions the less their gripping effect. Conversely, the greater the cylindricality of the protrusions the greater their gripping effect. In natural and artificial turf applications, multiplicities of protrusions engage with blades of grass or tufts of turf like the teeth of a hair comb engage with strands of hair. Somewhat as the series of teeth in a comb deter combing, the disposals and multiplicity of the cylindrical or conical shaped protrusions on the shoe of this application inhibit slippage.

Because of their flexibility the protuberances flex and bend under the weight of the wearer; and the spaces between adjacent protuberances form in the case of a football shoe, for instance, pockets into which the fibers of artificial or natural turf enter and are meshed or gripped so as to provide a firm footing at all times for the athlete whether running ahead or twisting laterally, while at the same time giving the athlete the traction required for sudden turns or stops, avoiding injuries.

The shoes may be constructed in various ways. For instance the lower edges of the upper may be cemented or sewn between the insole, and the midsole with the outsole cemented thereto, as shown in FIG. 5, and the insole may be additionally covered with a liner 50 as shown in FIG. 6. Then, too, the upper 22 may be carried under the insole 24 and fastened by tape 52 to the outsole 28, as shown in FIG. 7. FIG. 8 shows a still further embodiment of the invention in which the outsole 28 is skived and bonded to the upper 22 which is held between the liner 24 and the outsole 28.

While the invention has been described then, in connection with different embodiments thereof, it will be understood that it is capable of further modification, and that this application is intended to cover any variations or modifications of the invention that come within the scope of the invention or the limits of the appended claims.

Having thus described my invention, what I claim is:

1. An athletic shoe particularly suited for use on both artificial and natural turfs, resepectively, having an insole, a flexible backing secured to the underside of said insole, a flexible outsole secured to said backing, and a plurality of spaced, flexible protuberances carried by said outsole and providing a non-slip tread for the shoe, said protuberances being uniformly spaced, flexible members integral with the outsole and projecting downwardly beyond the bottom surface of said outsole in rows spaced laterally and longitudinally of the outsole, and said protuberances being circular in cross section and having diameters ranging from 3/16 inch to ⅜ inch, heights ranging from 5/32 inch to ½ inch and center to center spacing between protuberances ranging from ¼ inch to ¾ inch.

2. A shoe as claimed in claim 1, wherein the protuberances are of inverted, truncated conical shape having minor diameters ranging from 3/16 inch to ¼ inch and major diameters ranging from 5/16 inch to ⅜ inch and spacing between protrusions ranging from ½ inch to ¾ inch.

3. A shoe as claimed in claim 1, wherein the protuberances are cylindrical having 5/32 inch diameters, 5/32 inch heights, and ¼ inch center to center spacing from each other.

* * * * *